United States Patent [19]

Bernard et al.

[11] 4,402,593

[45] Sep. 6, 1983

[54] GROUNDING DEVICE FOR MOVING PHOTOCONDUCTOR WEB

[75] Inventors: Richard A. Bernard, Norwalk; Pushpavadan S. Nagarsheth, Danbury; Peter G. Edelman, Wilton, all of Conn.

[73] Assignee: Pittney Bowes Inc., Stamford, Conn.

[21] Appl. No.: 336,114

[22] Filed: Dec. 31, 1981

[51] Int. Cl.[3] ..... G03G 15/00

[52] U.S. Cl. ..... 355/3 BE; 355/3 R; 355/3 CH; 355/14 CH; 361/212; 361/221

[58] Field of Search ..... 355/3 R, 3 CH, 3 BE, 355/16, 14 R, 14 CH; 361/212, 220, 225, 221

[56] References Cited

U.S. PATENT DOCUMENTS

| | | | |
|---|---|---|---|
| 4,049,343 | 9/1977 | Hermanson | 361/221 X |
| 4,273,437 | 6/1981 | Neumann | 355/3 BE |
| 4,336,565 | 6/1982 | Murray et al. | 355/3 CH X |
| 4,344,698 | 8/1982 | Zeman | 355/16 |
| 4,352,143 | 9/1982 | Uno | 361/221 |

*Primary Examiner*—A. C. Prescott

*Attorney, Agent, or Firm*—Lawrence E. Sklar; William D. Soltow, Jr.; Albert W. Scribner

[57] ABSTRACT

An improvement in an electrophotographic copying machine having a movable photoconductor web rotatably mounted on at least a pair of rollers, the web having an insulative support layer, an electrically conductive layer disposed on the support layer, and a photoconductive layer disposed on the electrically conductive layer. The improvement comprises a stationary contact electrically connectable to a fixed electrical potential and slidably in contact with the electrically conductive layer, the stationary contact consisting of a grounding brush having a multiplicity of fibers, each of said fibers comprising a nylon 6 filamentary polymer substrate having finely divided, electrically conductive particles of carbon black suffused through the surface of the filamentary polymer substrate, the electrically conductive particles being present inside the filamentary polymer substrate as a uniformly dispersed phase independent of the phase of the filamentary polymer substrate in an annular region located at the periphery of the filamentary polymer substrate and extending inwardly along the length thereof, the electrically conductive particles being present inside the filamentary polymer substrate in an amount sufficient to render the electrical resistance of the electrically conductive textile fiber not more than about $10^9$ ohms/cm.

4 Claims, 4 Drawing Figures

GROUNDING DEVICE FOR MOVING PHOTOCONDUCTOR WEB

BACKGROUND OF THE INVENTION

The instant invention relates to electrophotographic apparatus, and more particularly to electrophotographic apparatus in which a photoconductor, movable past a plurality of electrophotographic stations, has an insulating support web with, in turn, an electrically conductive layer, and a photoconductive layer disposed thereon, in which there is or can be an electrical connection between the electrically conductive layer and a stationary contact at a fixed potential.

In the field of electrophotographic reproduction today, increasing use is being made of photoconductors that consist not of a rigid metal roller having a photoconductive material disposed thereon but of a flexible web comprising a support, a conductive layer and a photoconductive layer. If such photoconductors are not disposed on drums, but are used in the form of continuous webs which are conveyed, for example, by several guide rollers, there is some difficulty in bringing the electrically conductive metal layer of this photoconductor into electrical contact with a fixed potential elsewhere on the apparatus. This electrical contact must be effective and reliable, and at the same time must not destroy the very thin metal of the conductive layer during the working life of the photoconductor.

Numerous attempts already have been made to achieve an effective and reliable contact which does not destroy the conductive layer of the photoconductor, including an attempt to produce the contact by rolling as opposed to sliding. In this case, too, however, the electrically conductive layer was destroyed long before the photoconductor was worn out. The use of metallic conductive brushes has also resulted in a very rapid destruction of the electrically conductive layer of the photoconductor.

A recent approach to the electrical contact problem in photoconductor webs is described in U.S. Pat. No. 4,027,967, issued June 7, 1977, wherein the contact is achieved using a stationary graphite surface. However, graphite is extremely brittle, and if the graphite breaks, an electrical short may develop possibly causing a fire to occur.

The instant invention accordingly provides an electrical grounding device for the photoconductor having all the advantages of graphite but without the brittleness of graphite and the attendant fire hazard.

SUMMARY OF THE INVENTION

The instant invention is an improvement in an electrophotographic copying machine having a movable photoconductor web rotatably mounted on at least a pair of rollers, the web having an insulative support layer, an electrically conductive layer disposed on the support layer, and a photoconductive layer disposed on the electrically conductive layer. The improvement comprises a stationary contact electrically connectable to a fixed electrical potential and slidably in contact with the electrically conductive layer, the stationary contact consisting of a grounding brush having a multiplicity of fibers, each of said fibers comprising a nylon 6 filamentary polymer substrate having finely divided, electrically conductive particles of carbon black suffused through the surface of the filamentary polymer substrate, the electrically conductive particles being present inside the filamentary polymer substrate as a uniformly dispersed phase independent of the phase of the filamentary polymer substrate in an annular region located at the periphery of the filamentary polymer substrate and extending inwardly along the length thereof, the electrically conductive particles being present inside the filamentary polymer substrate in an amount sufficient to render the electrical resistance of the electrically conductive textile fiber not more than about $10^9$ ohms/cm.

DETAILED DESCRIPTION

Figure 1:
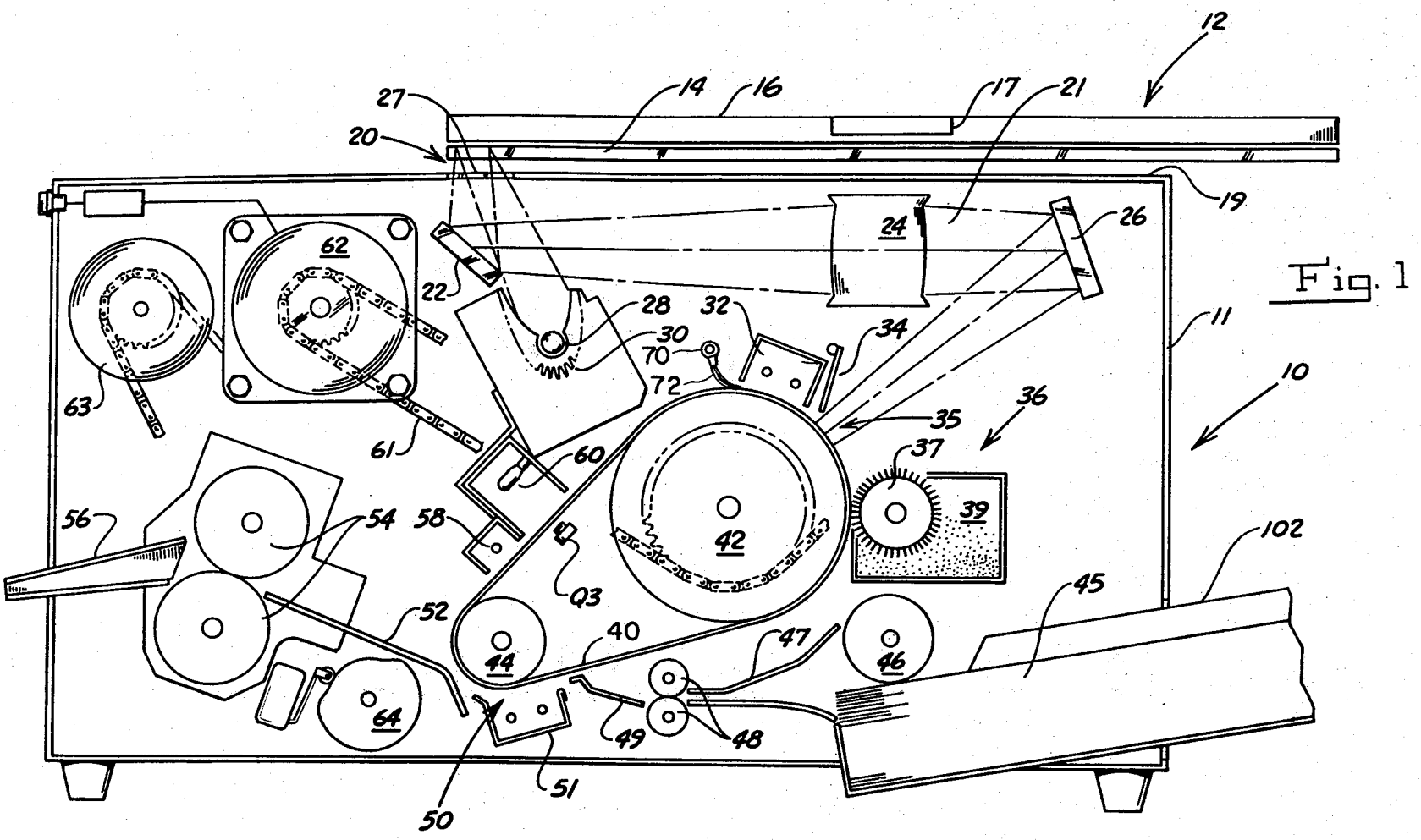
FIG. 1 is a schematic, side elevational view of an electrophotocopying machine employing an electrical grounding device for the photoconductor web in accordance with the instant invention.

In describing the preferred embodiment of the instant invention, reference is made to the drawings, wherein there is seen in FIG. 1 a copier 10 having a rectangular reciprocating carriage 12 that is movably mounted on top of a cabinet 11. The carriage 12 includes a transport platen 14 on which documents are placed face down for copying. Overlying the platen 14 is an opaque, movable cover 16 which has a white surface juxtaposed to the platen 14. The cover 16 is connected to one side of the carriage 12. In the preferred embodiment, the cover 16 is made of a relatively flexible material that is connected by a hinge to one of the longer sides of the carriage 12. The cover 16 has a handle 17 disposed opposite the hinged side of the cover 16. An operator can manipulate the handle 17 in order to raise and lower the cover 16 and thereby place documents on or remove documents from the platen 14.

The carriage 12 is shown in FIG. 1 in its extreme right or home position. During a copy cycle, the carriage 12 moves to the left a predetermined distance that is long enough to enable the copier 10 to make copies of fourteen inch long documents. Underneath the carriage 12 is an illuminating station, generally indicated at 20. The illuminating station 20 includes a relatively narrow, transparent window 27 that is mounted on and extends across the width of the upper surface 19 of the cabinet 11. A light source is operatively disposed underneath the window 27. The light source comprises two lamps 28 axially aligned and partially surrounded by a shaped reflector 30 which serves to direct the light from the lamps 28 toward the window 27. As the carriage 12 moves from right to left, a document on the carriage passes over the illumination window 27 and is illuminated by the light from the lamps 28. In other words, the document is scan exposed across the illuminating station 20.

An image of the document is transmitted to a photoreceptor belt 40 at an imaging station generally designated 35. The image is transmitted along a Z-shaped path by an optical system 21 comprising tilted mirrors 22, 26 and a lens 24. The mirror 22 receives an image of the illuminated document as the latter passes over the window 27. The mirror 22 reflects the image toward the converging lens 24, which is focused upon the second tilted mirror 26 which in turn reflects the focused image onto a portion of the photoreceptor belt 40 at the imaging station 35. The photoreceptor belt 40 is moved through the imaging station at a predetermined speed in synchronism with the movement of the carriage 12 across the illuminating station 20. The motive power for turning the drive roller 42 is supplied by a main motor 62 through a suitable drive system that includes a drive chain 61 (partially shown). The chain 61 also drives other elements including a rotating magnetic brush 37, the carriage 12, and feed and queuing rollers 46 and 48 respectively. Control cam 64 and fixing rollers 54 are driven by a second motor 63.

The rollers 42, 44 supporting the photoreceptor belt 40 are diagonally displaced from each other and their respective axes are angularly disposed with respect to each other, i.e., the axes are skewed or not parallel. By virtue of the relative differnce in size between the two rollers 42, 44, the photoreceptor belt 40 takes on a shape similar to a teardrop.

The belt 40 consists of a substrate 41, such as polyethylene teraphythalate or other dielectric film having a thin (25–600 angstroms), conductive layer 43, such as aluminum, which is typically applied by vaporizing or sputtering. The top layer 53 of the belt 40 is photosensitive, and may consist of zinc oxide, an organic photosensitive material, or other photosensitive material.

Disposed around the periphery of the photoreceptor belt 40 are a number of the operating components of the copier 10. In particular, a two-wire corona charging unit 32 is juxtaposed to the photoreceptor belt 40 at approximately a one o'clock position with respect to the drive roller 42. The charging unit 32 is operable to impart a uniform electrostatic charge to the photosensitive surface 45 of the photoconductor belt 40. The drive roller 42 turns in a clockwise direction, so that the uniformly charged surface of the photoconductor belt 40 moves from the charging unit 32 toward the imaging station 35. A blade-like shutter 34 is operatively associated with the imaging station 35. The shutter 34 is movably mounted in the copier 10 for manipulation by an operator in order to adjust the amount of light that strikes the photoreceptor belt 40 at the imaging station 35. In accordance with the well-known photocopying technique, the light-struck areas of the photoreceptor belt 40 are electrically discharged, thereby leaving a latent (undeveloped) electrostatic image that corresponds to the indicia areas (printed portions) of the document that is to be copied.

As the drive roller 42 turns, the latent image on photoreceptor belt 40 is carried past a developer station 36 disposed at a three o'clock position with respect to the drive roller 42. The developer station 36 includes a hopper 39 for holding a supply of developer material. The preferred embodiment of the invention uses a two component developer consisting of iron filings and pressure fixable marking material (toner); however, a single component developer material can also be used. Such developer materials and developer stations are well-known in the art and so it is only necessary to discuss them to the extent of their function in the overall copying process that is carried on by the copier 10. Suffice it to say that the rotating magnetic brush 37 picks up developer material from the hopper 39 and carries that developer material into contact with the photoreceptor belt 40. The charged or latent image areas of the photoreceptor belt 40 electrostatically attract and hold the toner particles, thus developing the latent image.

The toned or developed image leaves the developer station 36 and moves toward the transfer station 50 where there is a two-wire corona transfer charging apparatus 51. In timed relationship with the arrival of the toned image at the transfer corona 51, a copy sheet also arrives at the transfer station 50. The copy sheet is fed from a supply of sheets 45 stored in a removable tray 102. The feed roller 46 feeds the uppermost copy sheet from the supply 45, through a paper guide 47 and into the nip of the queuing rollers 48. At a predetermined time in the course of a copy cycle, the queuing rollers 48 are actuated to feed the copy sheet along a paper guide 49 and into contact with the developed image carried on the photoreceptor belt 40. By virtue of the electric charge that is generated by the transfer corona 51, toner particles are attracted from the photoreceptor belt 40 toward the copy sheet to which they loosely adhere.

The copy sheet is separated from the photoreceptor belt 40 by the interaction of the small diameter idler roller 44, the copy sheet does not follow the belt 40. Instead, the leading edge of the copy sheet moves away from the belt along a path that is initially tangent to the idler roller 44. The copy sheet is ultimately guided by a paper guide 52 into the nip of the pressure fixing rollers 54.

The pressure fixing rollers 54 include two stainless steel rollers that are spring loaded into contact with each other with a linear pressure of approximately three hundred pounds per linear inch. The axes of pressure rollers 54 are slightly skewed with respect to each other in order to maintain the rollers 54 in contact. Otherwise, the rollers 54 would tend to deform thereby leaving a gap between them at their nip. The rollers 54 are rotated such that the speed of a copy sheet through the rollers 54 is slightly slower than the speed at which the copy sheet is fed toward the rollers 54. This is necessary in order to assure that the rollers 54 do not prematurely pull the copy sheet from the photoreceptor belt 40, i.e. before transfer of toner to the copy sheet is complete, which would result in an imperfect streaked copy. Hence, the copy sheet is permitted to buckle slightly before it is completely fed through the rollers 54. Such a slight buckle does no damage to the loosely held toner image that is carried on the copy sheet. Under the influence of the high pressure exerted on the pressure fixable toner by rollers 54, the image is permanently fixed to the copy sheet as it passes through fixing rollers 54 and into the receiving tray 56.

After the developed image is transferred, a residual latent electrostatic image and some untransferred toner remain on the photoreceptor belt 40. As the belt 40 continues along its path, it is carried past a single wire discharge corona 58 which neutralizes any charge on the untransferred toner. Next, the belt 40 passes underneath an array (preferably four) of incandescent erase lamps 60. Light from the erase lamps 60 illuminates the belt 40, discharges the residual latent image areas of the belt 40 and thereby erases any remaining residual electrostatic image.

As the photoreceptor belt 40 begins its second cycle, the carriage 12 starts to return from its extreme left position toward its extreme right or home position. During the second cycle, the corona 32 and the transfer corona 51 are de-actuated. By virtue of the effects of the erase lamps 60 and the discharge corona 58, the untransferred toner is now only loosely adhering to the photoreceptor belt 40. As the untransferred toner passes the magnetic brush 37, the latter attracts the untransferred toner from the belt 40 onto the magnetic brush 37. Hence, the magnetic brush 37 performs two functions: on the first cycle the magnetic bruish 37 develops the latent electrostatic image and on the second cycle the magnetic brush 37 cleans the photoreceptor belt 40 of any untransferred toner. Thus, after the second cycle, the photoreceptor belt 40 is cleaned of toner and ready to make another copy.

Figure 3:
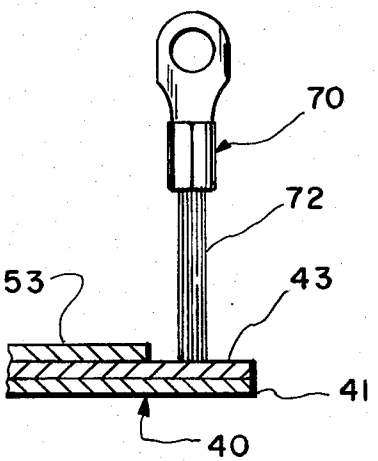
FIG. 3 is an enlarged, vertical sectional view of the photoconductor web and grounding device seen in FIG. 2.
Figure 2:
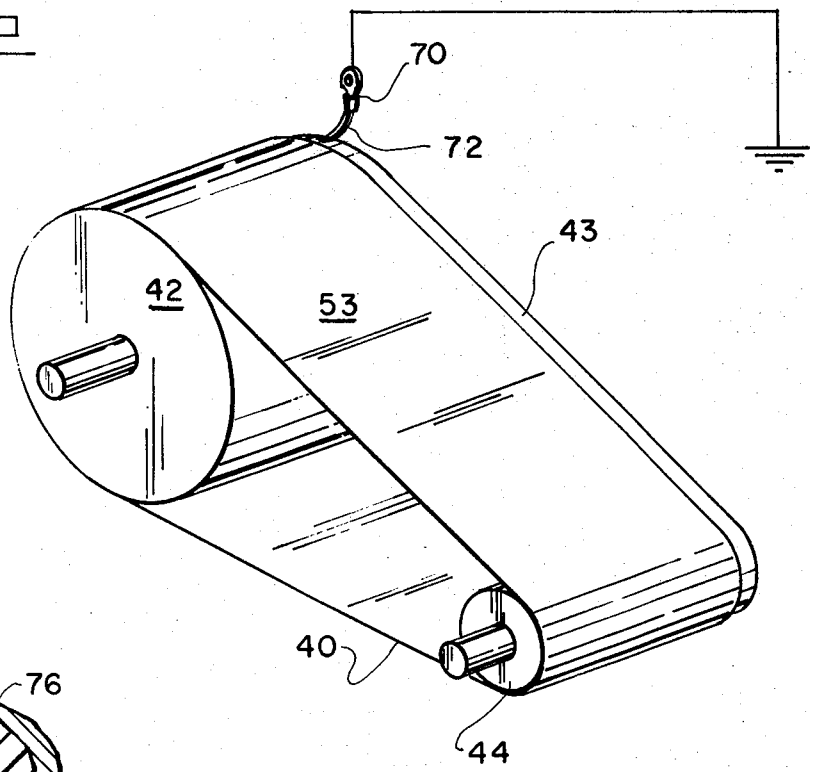
FIG. 2 is a schematic, perspective view of the grounding device and photoconductor web seen in FIG. 1.
Figure 4:
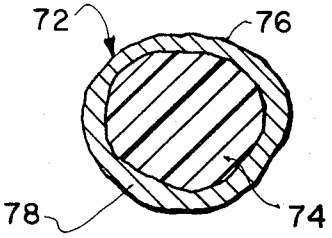
FIG. 4 is an enlarged, radial cross sectional view of one of the fibers comprising the grounding device.

Referring now to FIGS. 2–4, it can be seen that the conductive layer 43 of the photoconductor belt 40 includes an exposed marginal portion suitable for slidable contact with a grounding brush 70 consisting of a plurality of fibers 72. Typically, the grounding brush 70 may be formed with only 200–300 fibers. A cross section of each of the fibers 72 is seen in FIG. 4. The structure and properties of the fibers 72 are described in U.S. Pat. No. 4,255,487 issued Mar. 10, 1981 to Badische Corporation, the entirety of which is hereby incorporated into the instant specification by reference. Each of the fibers 72 comprises a nylon 6 filamentary polymer substrate 74 having finely divided, electrically conductive particles of carbon black suffused through the peripheral surface 76 of the filamentary polymer substrate 74. The electrically conductive particles are present inside the filamentary polymer substrate 74 as a uniformly dispersed phase 78 independent of the phase of the filamentary polymer substrate 74 in an annular region located at the periphery 80 of the filamentary polymer substrate 74 and extending inwardly along the length thereof. The particles of carbon are present inside the filamentary polymer substrate 74 in an amount sufficient to render the electrical resistance of the electrically conductive fiber not more than about $10^9$ ohms/cm. When the filamentary polymer substrate 74 is of substantially cylindrical configuration, which is very common in the art, it is especially advantageous if the annular region of suffused electrically conductive particles 78 extends perpendicularly inwardly from the peripheral surface 76 of the filamentary substrate 74 up to a distance equal to about 1/10 the radius of the filamentary polymer substrate 74. Under such conditions, the physical properties of the suffused filamentary substrate 74 still closely approximate those of the unmodified, filamentary substrate while the conductivity thereof has been strikingly increased. For cross-sectional configurations other than circular (e.g. trilobal, square, rectangular, etc.) the annular region most advantageously extends up to a distance equal to about 1/10 the radius of a circle inscribed within the cross-sectional perimeter of the filament.

Although the present invention has been described in detail with respect to certain preferred embodiments thereof, it is apparent to those of skill in the art that variations and modifications in this detail may be effected without any departure from the spirit and scope of the present invention, as defined in the appended claims below.

What is claimed is:

1. In an electrophotographic copying machine having a movable photoconductor web rotatably mounted on at least a pair of rollers, said web having an insulative support layer, a vapor deposited aluminum layer disposed on said support layer, and a photoconductive layer disposed on said aluminum layer, the improvement comprising a stationary contact electrically connectable to a fixed electrical potential and slidably in contact with said aluminum layer, said stationary contact consisting of a grounding brush having a multiplicity of fibers, each of said fibers comprising a nylon 6 filamentary polymer substrate having finely divided, electrically conductive particles of carbon black suffused through the surface of the filamentary polymer substrate, the electrically conductive particles being present inside the filamentary polymer substrate as a uniformly dispersed phase independent of the phase of the filamentary polymer substrate in an annular region located at the periphery of the filamentary polymer substrate and extending inwardly along the length thereof, the electrically conductive particles being present inside the filamentary polymer substrate in an amount sufficient to render the electrical resistance of the electrically conductive textile fiber not more than about $10^9$ ohms/cm.

2. The improvement of claim 1, wherein the filamentary polymer substrate is of substantially cylindrical configuration, and the annular region of uniformly dispersed electrically conductive particles extends perpendicularly inwardly from the periphery of the filamentary polymer substrate up to a distance equal to about 1/10 the radius of the filamentary polymer substrate.

3. The improvement of claim 2, wherein the aluminum layer is between 25 and 600 angstroms thick.

4. The improvement of claim 2, wherein the photoconductive layer comprises an organic material.

* * * * *